US006953033B2

(12) United States Patent
Vanek et al.

(10) Patent No.: US 6,953,033 B2
(45) Date of Patent: Oct. 11, 2005

(54) RING AIRFOIL LAUNCHER TOY WITH SAFETY FEATURES

(76) Inventors: Chester F. Vanek, 1171 Redrock Ct., Sunnyvale, CA (US) 94089; Abraham Flatau, 3330 Veron Ter., Palo Alto, CA (US) 94303

( * ) Notice: Subject to any disclaimer, the term of this patent is extended or adjusted under 35 U.S.C. 154(b) by 0 days.

(21) Appl. No.: 10/832,827

(22) Filed: Apr. 27, 2004

(65) Prior Publication Data

US 2005/0034714 A1 Feb. 17, 2005

Related U.S. Application Data

(60) Provisional application No. 60/467,594, filed on May 2, 2003.

(51) Int. Cl.[7] ..... F41B 7/08
(52) U.S. Cl. ..... 124/16; 124/81
(58) Field of Search ..... 124/16, 17, 21, 124/27, 81

(56) References Cited

U.S. PATENT DOCUMENTS 5,447,144 A * 9/1995 Ivy ..... 124/26
5,970,970 A 10/1999 Vanek et al.
5,979,424 A * 11/1999 Alvarez et al. ..... 124/16
6,599,161 B2 7/2003 Hunter
6,742,509 B2 6/2004 Hunter et al.
2003/0051719 A1 3/2003 Vanek et al.

* cited by examiner

*Primary Examiner*—John A. Ricci
(74) *Attorney, Agent, or Firm*—Weide & Miller, Ltd.

(57) ABSTRACT

A ring airfoil launcher comprises a main support on which is movably mounted a ring airfoil accepting conical chuck and a retractor. A stop mounted on the main support for limiting forward movement of the chuck. A spring biases the chuck towards the stop. The retractor is mounted distal of the chuck and includes a latch for connecting it to the chuck. Rearward movement of the retractor causes rearward movement of the chuck, extending said spring. Twisting of the retractor rotates the chuck, winding the spring. A release disengages the latch from the chuck, allowing the spring to pull the chuck forward along the main support towards the stop, and rotating the chuck as it unwinds, causing the ring airfoil mounted on said chuck to be released from the launcher with forward velocity and stabilizing spin.

15 Claims, 2 Drawing Sheets

RING AIRFOIL LAUNCHER TOY WITH SAFETY FEATURES

RELATED APPLICATION

This application claims priority to U.S. Provisional Application Ser. No. 60/467,594, filed May 2, 2003.

FIELD OF THE INVENTION

The present invention relates to ring airfoil launchers.

BACKGROUND OF THE INVENTION

Projectile launching toys are an age old favorite. Toys which launch discs, balls and other elements are well known.

The ring airfoil is a relatively new flying device in the field of toys and sporting goods. Ring airfoils are known in military and similar applications. However, it took a number of years before the ring airfoil was successfully adapted to toy and sporting good applications. In particular, a variety of factors must be addressed in order for a ring airfoil to be successfully launched with stable flight characteristics. These factors include launch velocity, spin-to-translation ratio, and angle of attack.

The first successful ring airfoil launching toy was the Vortex Tornado. This launcher is described in U.S. Pat. No. 4,970,970. As described therein, the launcher has a simple launch engine comprised of a hollow guide member fitted with a chuck. The chuck is mounted to slide longitudinally along the surface of the guide member.

A helical slot extends longitudinally along the guide member. The chuck is connected to a cross-bar that is located in the slot. A source of motive power in the form of a spring or rubber band is connected to the cross-bar inside of the guide member.

In use, a ring airfoil is placed on the chuck and the chuck is retracted along the guide member, energizing the spring or band. A trigger is utilized to release the chuck. The spring or band then moves the cross-bar and connected chuck forward along the guide member. As this occurs, the cross-bar rotates as is follows the helical slot formed in the guide member, thus causing the chuck to rotate as well. When the chuck reaches the end of the guide member, the ring airfoil is launched therefrom. Most importantly, at this time the ring airfoil has been imparted with forward velocity and stabilizing spin. In addition, the ring airfoil is launched with the requisite zero degree angle of attack because the ring airfoil is mounted squarely on the chuck, which is maintained in alignment with the guide member.

Because this launcher addressed the requisite factors for launching a ring airfoil for stable flight, the product was a tremendous success in the marketplace. Since that time, there have been other attempts to develop other types of toy ring airfoil launchers.

The invention described in Published U.S. Application 2002/0155779 is one such attempt. This invention is a airfoil launcher which includes a ring airfoil chuck mounted on an elongate member. A similar motive force in the form of a pair of elastic bands are connected to the chuck. Instead of imparting rotation of the chuck using movement along a helical slot, the rotation is effected via the bands. In particular, a draw-string mechanism is utilized to pull the chuck rearward. As this occurs, the bands are energized and are twisted along a helical path. When the chuck is released, the bands draw the chuck forward along the member, twisting the chuck.

This and other later launchers have various drawbacks. One significant drawback to the launcher just described is that the amount of spin which can be imparted on the airfoil is very limited, causing the airfoil to have significantly less in-flight stability. This is because the bands can not be twisted by more than 180 degrees or else no rotational torque is generated. Thus, only a very limited amount of rotational force can be generated by the bands, that force limited to that which is generated by offsetting the ends of each band by less than 180 degrees about the member.

Other problems include the fact that when the chuck is released, it also moves the draw-string forward in a sharp motion. The draw-string, which includes a grip, may thus fly forward an impact the user, third parties or other objects.

An effective ring-airfoil launching toy which is safe, convenient to use and which effectively launches a ring airfoil projectile is desired.

SUMMARY OF THE INVENTION

The invention is a ring airfoil launcher and a method of launching a ring airfoil. The launcher is particularly configured for use as a toy or in similar sporting environments.

In one embodiment, the launcher includes a main support having a first end and a second end. A chuck is movably mounted on the main support. In a preferred embodiment, the chuck includes a conical body for accepting a ring airfoil thereon.

A stop is mounted on the support for limiting the movement of the chuck towards the first end of the main support. The launcher includes a motive force for the chuck. In one embodiment, this comprises a coil spring which is mounted over the main support and which has one end connected to the main support and the other connected to the chuck.

A retractor is also movably mounted on the main support, the retractor located distal of the chuck. A connector is configured to selectively connect the retractor to the chuck. In one embodiment, the connector is a pivoting latch which is supported by the retractor. The latch has a first end having the form of a catch for selectively engaging a ledge comprising an outwardly extending, annular wall which is located on the chuck.

The launcher also includes a release causing the connector to disengage from the chuck, allowing the spring to move the chuck forward. In one embodiment, the latch has a tapered second end which extends rearward of the retractor. A handle is mounted at the second end of the main support. The handle defines a slot for accepting the second end of the latch. When the retractor is moved rearward, the rear end of the latch is pivoted down, causing the first end to be pivoted up out of engagement with the ledge of the chuck.

In use, a ring airfoil is placed upon the chuck. The retractor is moved forward to the chuck and is connected thereto, such as by engaging the latch. The retractor is then drawn rearwardly along the main support in a direction from its first end towards its second end. As the chuck is drawn rearward, the spring is extended. Preferably, the retractor is twisted or rotated about the main support as it is moved rearwardly, also twisting the chuck and thus winding the spring.

Once moved to the cocked or retracted position, the chuck is released from the retractor. This step may comprise moving the retractor rearwardly to the point the second end of the latch engages the slot in the handle.

Once the chuck is released, the chuck is drawn forward in the direction of the first end of the support member with the spring. At the same time, the chuck is rotated as the spring unwinds. When the chuck reaches the stop, the ring airfoil is released from the chuck and projected from the launcher with a forward velocity and imparted spin.

The launcher has a number of safety features and advantages. In one embodiment, a safety cap or tip is located at the first end of the main support, preventing jabbing or the like. Preferably, the chuck defines a smooth, broad cone shape, reducing the risk of injury in the event a portion of someone's body inadvertently gets in the path of the moving chuck.

The launcher effectively launches a ring airfoil projectile with forward velocity and stabilizing spin. In addition, the ring airfoil is launched with zero angle of attack, contributing to long, stable flight.

In one embodiment, the amount of spin, including the direction of spin, may be custom-selected by the user.

Further objects, features, and advantages of the present invention over the prior art will become apparent from the detailed description of the drawings which follows, when considered with the attached figures.

DETAILED DESCRIPTION OF THE INVENTION

The invention is a ring airfoil launcher, and more particularly a ring airfoil launching toy having safety features. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention is a ring airfoil launcher. The launcher includes a chuck movable along a guide member. A cocking mechanism is configured to engage the chuck for movement into a retracted, twisted position. When released, the chuck moves forward while rotating, thus imparting significant forward velocity and spin upon a ring airfoil mounted on the chuck. As one aspect of the invention, the amount of velocity and spin which is imparted upon the ring airfoil can be customized.

Figure 1:
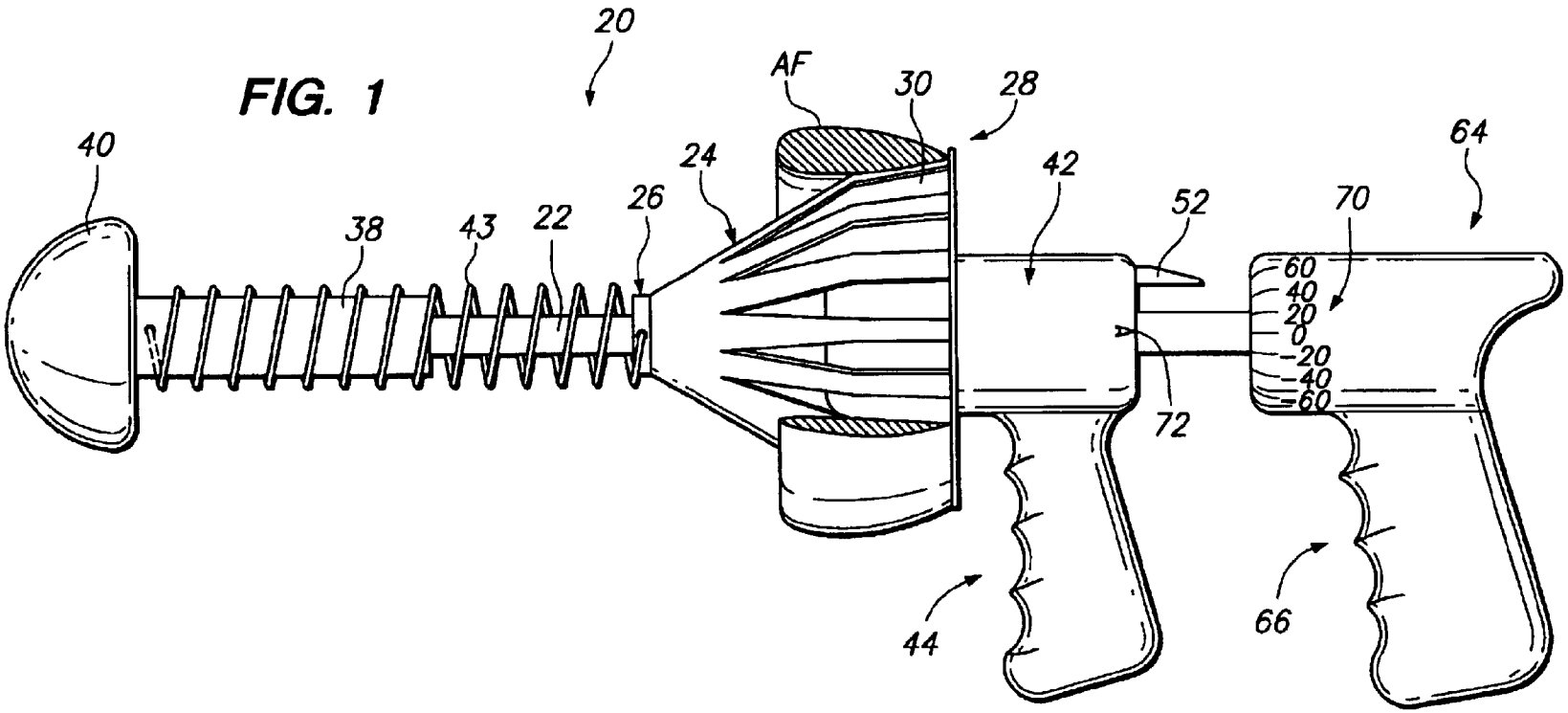
FIG. 1 is a side view of a ring airfoil launching toy in accordance with an embodiment of the invention, a ring airfoil to be launched by the toy shown in partial cross-section.

Referring to FIG. 1, one embodiment of the invention is a ring airfoil launcher 20. The launcher 20 is specifically configured for use as a toy or similar recreational sporting good. The launcher 20, however, could be designed for other applications or purposes, and various features of the invention may have applicability in other settings.

As illustrated, the ring airfoil launcher 20 includes a main support, mount or member 22. As described in more detail below, the functions of this main member 22 include supporting various components of the launcher 20 and guiding one or more components of the launcher.

In a preferred embodiment, the main member 22 has the form of an elongate rod having a first end an a second end. In the embodiment illustrated, the rod has a generally circular cross-sectional shape. The rod could have other configurations, however.

Figure 2:
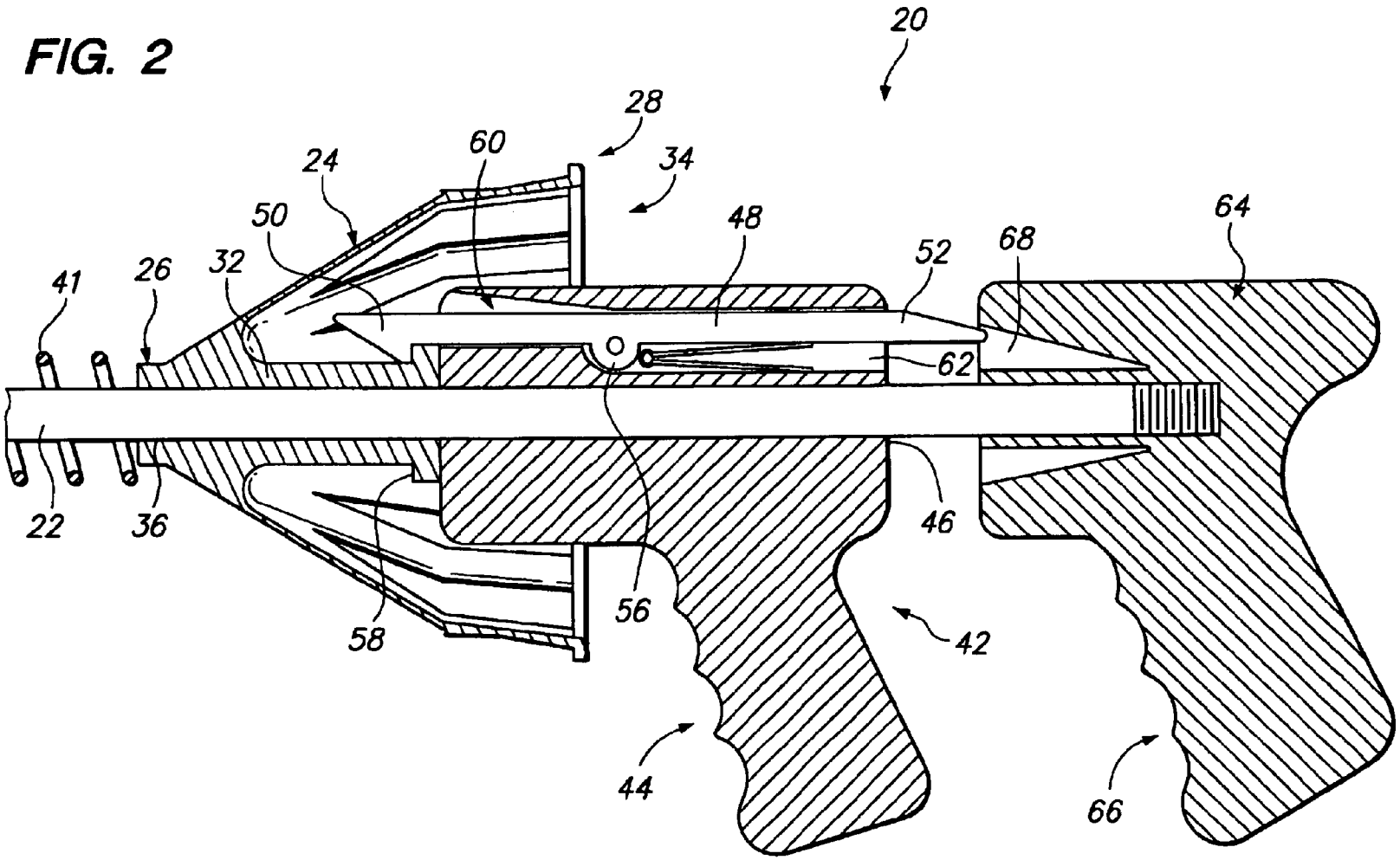
FIG. 2 is a partial cross-sectional view of the launcher of the invention.

Referring to FIGS. 1 and 2, a chuck 24 is movably mounted on the main member 22. The chuck 24 is preferably configured to support a ring airfoil RF thereon for launching by the launcher 20. FIG. 1 illustrates, in partial cross-sectional view, one example of a ring airfoil RF. Such ring airfoils are well known in the art. In general, the ring airfoil RF comprises an annular body defining a central circular opening. The ring airfoil RF may have a variety of configurations (for example, the "wing" shape of the body may vary) and may be constructed of a variety of materials. Preferably, in the toy application, the ring airfoil RF is constructed of a durable but somewhat elastic and lightweight material so that it does not cause damage to persons or property which it impacts.

In one embodiment, the chuck 24 includes a generally cone shaped body for accepting the ring airfoil RF thereon. As illustrated, the chuck 24 has a first end 26 and a second end 28. The first end 26 has a generally small dimension, while the second end 28 has a much larger dimension.

In one embodiment, the body of the chuck 24 is generally thin-walled. As illustrated, the body may define a plurality of openings 30, such as slots. The openings 30 allow air to pass through the chuck 24 when it is moving forward, lessening the air resistance. In addition, the openings 30 may also allow the body to be more flexible for accepting different sized ring airfoils RF thereon.

Referring to FIG. 2, the chuck 24 preferably also includes a central hub 32. As illustrated, the hub 32 extends from the first end 26 towards the second end 28 of the chuck 24. The remainder of the body of the chuck 24 is spaced outwardly therefrom, thus creating a generally hollow interior space.

A passage 36 extends through the hub 32 of the chuck 24. The passage 36 is preferably sized and shaped for accepting the main member 22 therethrough. Preferably, the passage 36 is closely sized to the main member 22 so that the chuck 24 will move along the main member 22, but to prevent wobble or similar non-linear motion.

The chuck 24 maybe constructed of a variety of materials. In one embodiment, the chuck 24 is molded from plastic or a similar durable, resilient material.

As described in more detail below, the chuck 24 is designed to be moved along the main member 22 between its first and second ends. As illustrated in FIG. 1, a stop 38 is located on the main member 22. The stop 38 is configured to limit the forward movement of the chuck 24. As illustrated, the stop 38 comprises an enlarged member located on or formed as a portion of the main member 22. The stop 38 is preferably sufficiently large that it will not travel through the passage 36 in the chuck 24.

In one embodiment, a safety cap or tip 40 is located at the first end of the main member 22. The safety cap 40 is a member of enlarged dimension and having defining smooth surfaces. As illustrated, the safety cap 40 has the shape of a hemisphere. The safety cap 40 is preferably constructed of a durable material, such as molded plastic. The safety cap 40 advantageously protects against accidental jabbing or poking which might otherwise cause injury. The safety cap 40 may be formed with the stop 38 and/or main member 22 or be attached thereto.

The launcher 20 includes means for imparting a launching force upon the ring airfoil RF. In one embodiment, this means comprises a coil spring 43. As illustrated, the coil spring 43 is mounted over the main member 22 and extends between the safety cap 40 and the chuck 22. In the embodiment illustrated, a first end of the coil spring 43 is connected to the stop 38 near the safety cap 40, and a second end of the coil spring 38 is connected to the first end 26 of the chuck 22.

Other means may be provided for imparting the launching force, such as resilient bands, coil springs mounted in or along the main member, and other devices. As described below, however, the coil spring 43 illustrated and its particular manner of mounting have particular advantages.

In general, the coil spring 43 is configured to draw or move the chuck 24 forward along the main member 22 to the stop 38. Means are provided for moving or retracting the chuck 24 to a cocked or retracted position in which the coil spring 43 is extended. In this position, the coil spring 43 is stretched such that, when released, it draws the chuck 22 foward.

In one embodiment, the spring 43 has a torque constant which is about one-fifth, or twenty percent, of its translational constant. Thus, if the spring is rotated by one-fifth of the distance it is extended, then the spring will generate (upon release) one-fifth as much twisting force as retracting force (which, as described below, relates to airfoil forward velocity and spin).

Referring to FIGS. 1 and 2, in one embodiment, this retracting means comprises a retractor 42. As illustrated, the retractor 42 comprises a body which, in one embodiment, defines a grip 44. The grip 44 is preferably configured to be grasped by the hand of a user of the launcher 20.

As illustrated in FIG. 2, a main portion of the body of the retractor 42 defines passage 46. The passage 46 is sized and shaped to accept the main member 22. As illustrated, the retractor 42 is thus mounted on the main member 22 for movement along the main member 22.

Means are provided for engaging or connecting the retractor 42 to the chuck 22. As illustrated, this means comprises at least one latch 48. As illustrated, the latch 48 has a first end and a second end. A first end of the latch 48 includes a catch 50. The second end of the latch 48 defines a tapered extension 52 for purposes later described.

The latch 48 is mounted for movement. As illustrated, the latch 48 is configured so that the catch 50 can be moved up and down. In one embodiment, the latch 48 defines a pivot 56 comprising a downwardly extending, semi-circular extension.

As best illustrated in FIG. 2, the retractor 42 can be moved to a position in which a forward or front end thereof is adjacent the second end of the hub 32 of the chuck 22. Preferably, the chuck 22 defines a ledge or wall 58 for selective engagement by the catch 50 of the latch 48. In a preferred embodiment, the ledge 58 is an outwardly extending annular member. The ledge 58 is preferably formed integrally with the hub 32, such as in the molding process.

When the catch 50 is in a downward position, it engages the ledge 58, thus securely connecting the chuck 22 to the retractor 42. In this position, when the retractor 42 is drawn rearwardly along the main member 22, such as by gripping the grip 44, the chuck 22 is also drawn rearwardly, stretching the coil spring 43.

In one embodiment, the catch 50 is biased into its downward, ledge engaging position. As illustrated, the latch 48 is mounted in a cavity 60 in the body of the retractor 42. The cavity 60 is sized to permit the rocking movement of the latch 48. In addition, the cavity 60 is configured to accept an insert 62. The insert 62 is preferably located under the portion of the latch 48 distal of the pivot 56, a rear portion of the latch 48 upwardly and a front portion, including the catch 50, downwardly.

Preferably, the insert 62 is compressible. In this manner, upon application of force, the rear portion of the latch 48 may be moved downwardly, and thus the front portion of the latch 48, including the catch 50, is moved upwardly. As described in more detail below, in this manner, the catch 50 is moved out of engagement with the ledge 58, thus releasing the chuck 22 from the retractor 42.

In a preferred embodiment, the launcher 20 includes a handle 64 located at the second end of the main member 22, generally opposite the safety cap 40. As illustrated, the handle 64 is a body which also defines a grip 66.

In a preferred embodiment, the handle 64 includes a latch 48 release mechanism. As illustrated, the handle 64 defines an annular slot 68 for engaging the sloping second end 52 of the latch 48. The slot 68 is defined by an outer wall or surface which slopes inwardly. In this manner, when the retractor 42 is drawn sufficiently rearwardly, the second end 52 of the latch 48, which extends outwardly therefrom, engages the handle 64. Because of the shape of the slot 68, after the latch 48 engages the slot, further rearward movement causes the second end 52 of the latch 48 to be pressed downwardly, thus raising the first end of the latch 48, including the catch 50, upwardly out of engagement with the ledge 58 of the chuck 24.

Operation of the launcher 20 will now be described in greater detail. First, in order to launch a ring airfoil AF, the airfoil must be located on the chuck 24. In one embodiment, a user passes a ring airfoil AF over the safety cap 40 and along the main member 22 until it is positioned on the chuck 24, as in the position illustrated in FIG. 1.

Next, the launcher 20 is preferably placed into the firing condition. After firing of a previous ring airfoil, the chuck 24 will be drawn forward towards the stop 38 by the spring 43, and away from the retractor 42 and handle 66. The user grips the retractor 42 and moves it forward along the main member 22 until it abuts the hub 32 of the chuck 22. Sufficient forward force will cause the catch 50 to engage the ledge 58, as illustrated in FIG. 2. At this time the chuck 24 is connected to the retractor 42.

The user may then drawn the chuck 24 rearwardly against the spring 43 by drawing the retractor 42 rearwardly towards the handle 66. Further, and importantly, the user can rotate the retractor 42, and thus the chuck 24, in an angular motion about the main member 22. As this occurs, the coil spring 43 is both extended and twisted from its unbiased position.

The user launches the ring airfoil AF by moving the retractor 42 rearwardly a sufficient distance that the second end 52 of the latch 48 engages the slot 68 in the handle 64. As this occurs, the latch 48 is pivoted so that the catch 50 disengages the ledge 58 of the chuck 24. At that time, the chuck 24 is free to move forward along the main member 22 under the force of the spring 43. Thus, the spring 43 accelerates the chuck 24 to a high forward velocity. At the same time, the spring 43 rotates the chuck 24 as the spring "unwinds" from back to its original angular position.

Forward movement of the chuck 24 is limited by the stop 38. When the chuck 24 impacts the stop 38, the ring airfoil AF continues to move forward. Most importantly, the ring airfoil AF is launched with a forward velocity, and with spin. Further, the ring airfoil AF is launched with a zero angle of attack.

The launcher 20 has numerous advantages. As described, the launcher is effective in launching a ring airfoil with forward velocity and stabilizing spin, and with zero angle of attack, for stable, long distance flight. This makes the launcher 20 very desirable as a toy, such as for launching across yards, in parks and the like.

One advantage of the launcher is the ability of the user to "customize" the amount of spin imparted upon the ring airfoil. As indicated, spin is important to stable ring airfoil flight. However, by imparting different levels of spin, the user may invoke a curved flight path for the ring airfoil AF. As described, in the preferred embodiment, the user may twist or turn the retractor 42 as it is retracted. In one embodiment, the retractor 42 and associated chuck 24 may be rotated in either direction from the unbiased position illustrated in FIG. 1. Thus, a "positive" or "negative" (e.g. right or left/clockwise or counterclockwise) spin may be thus imparted upon the ring airfoil.

The launcher 20 may include an indicator of the amount of spin which is selected. As illustrated in FIG. 1, markings 70 are provided on the handle 64 which indicate a rotational angle in degrees. The markings 70 indicate zero angle of rotation and positive and negative angles of rotation. In one embodiment, the markings 70 are incremented in twenty (20) degree increments.

A corresponding indicator 72 is provided on the retractor 42. Preferably, when the retractor 42 is in its resting, unbiased state, the indicator 72 aligns with the zero degree marking on the handle 64. When the retractor 72 is twisted, the indicator 72 aligns with one of the other markings 70, thus providing the user with an indication of the amount or level of twist which is imparted, and thus the amount and direction of spin which will be imparted upon the ring airfoil RF.

The markings 70 and indicator 72 may comprise printed labels or may be engraved or the like so as to be readily visible to the user. Of course, the markings 70 and indicator 72 may have a wide variety of forms other than as illustrated, including by having different increments of markings 70. In addition, other means could be utilized to display information regarding the rotational displacement of the retractor 42 from its natural position.

The launcher 20 has a variety of safety features. As indicated above, a safety cap 40 is located at the end of the launcher 20.

The shape of the chuck 24 is also advantageous in preventing injury. As indicated, the chuck 24 is preferably cone-shaped, thus presenting a wide, sloping surface. The design of this surface reduces the potential for injury if it strikes a part of the body which might intrude upon the launch path of the chuck when released.

The launcher has a very effective, but simple, configuration. For example, the launcher does not employ complex helical slotting in order to invoke the airfoil spin. The launcher also does not utilize resilient bands or canted arms, as in other designs, which elements are prone to breakage and a greater risk of injury. The retractor A variety of other configuration and features are contemplated. In one embodiment, the safety cap may be made colorful, may contain an electrically powered (such as battery powered) light, or hold a toy noisemaker. The light or noisemaker might be configured to be activated when the chuck impacts the stop, or by other means, such as a user actuated switch.

As described, when the retractor 42 may be rotated while it engages the chuck 24, thus rotating the chuck 24. This is effected by the engagement of the retractor 42, and more particularly the catch 48, engaging the ledge 58 via friction. If necessary, the ledge 58 may include one or more slots radially spaced from one another for engaging the catch 48. In this manner, positive connection between the catch 48 and ledge 58 may prevent any relative movement between the elements.

In one embodiment, the launcher may be configured with a trigger. For example, a trigger may be connected to the retractor 42, such as near the grip 44. The trigger may be configured to release the latch. In this manner, the user may release the chuck at any time as it is retracted, and not just when the retractor reaches the handle. This would allow, for example, the user to adjust the spring tension for launch.

In one embodiment, when the retractor 42 is pulled to its full retracted position, it may be locked into position, such as by connection to the handle 64 via a latch. The user might then use the trigger to release the chuck. In this manner, the user is permitted to relax while aiming the device before launching the ring airfoil AF.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A launcher configured to launch a ring airfoil comprising:

a main support having a first end and a second end;

a chuck movably mounted on said main support, said chuck comprising a conical body for accepting a ring airfoil thereon;

a stop mounted on said main support, said stop limiting the movement of said chuck towards said first end of said main support;

a spring biasing said chuck towards said stop;

a retractor movably mounted on said main support, said retractor located distal of said chuck;

at least one connector configured to selectively connect said retractor and said chuck, whereby movement of said retractor towards said second end of said main support when said retractor is connected to said chuck causes said chuck to move towards said second end, extending said spring; and a release causing said at least one connector to disengage, allowing said spring to move said chuck forwardly along said main support towards said stop, causing a ring airfoil mounted on said chuck to be released and projected off of said launcher.

2. The launcher in accordance with claim 1 wherein said retractor and chuck are mounted for rotation on said main support.

3. The launcher in accordance with claim 1 wherein said spring is a coil spring.

4. The launcher in accordance with claim 1 wherein said at least one connector comprises a latch supported by said retractor, said latch having a first end in the form of catch for selectively engaging a portion of said chuck.

5. The launcher in accordance with claim 4 wherein said chuck includes a central hub located around said main member, said hub defining a ledge for engagement by said catch of said latch.

6. The launcher in accordance with claim 4 wherein said latch has a second end extending from said retractor towards said second end of said main support.

7. The launcher in accordance with claim 6 wherein a handle is mounted at said second end of said main support, said handle including a slot for accepting said second end of said latch.

8. The launcher in accordance with claim 1 including a cap located at said first end of said main support.

9. A method of launching a ring airfoil projectile comprising the steps of:

placing a ring airfoil upon a chuck movably mounted on a support member;

engaging a retractor movably mounted on said support member with said chuck;

drawing said retractor rearwardly along said support member in a direction from a first end towards a second end;

extending a spring having a first end connected to said support member and a second end connected to said chuck;

twisting said retractor, and thus said chuck and spring connected thereto, about said support member;

releasing said chuck from said retractor;

drawing said chuck forwardly in the direction of said first end of said support member with said spring;

rotating said chuck as it moves forwardly by an unwinding of said spring; and releasing said ring airfoil from said chuck with a forward velocity and imparted spin.

10. The method in accordance with claim 9 including the step of stopping the forward movement of said chuck along said support member.

11. The method in accordance with claim 9 wherein said step of engaging said retractor with sad chuck comprises engaging a latch supported by said retractor with a portion of said chuck.

12. The method in accordance with claim 11 wherein said step of releasing said chuck from said retractor comprises releasing said latch from engagement with said chuck.

13. The method in accordance with claim 12 wherein said latch is configured to pivot relative to said retractor, and including the step of pressing a second end of said latch downwardly to raise a first end of said latch out of engagement with said chuck.

14. The method in accordance with claim 13 including the step of pressing said second end of said latch into a slot located in a handle mounted at said second end of said main support to press said second end of said latch downwardly.

15. The method in accordance with claim 9 wherein said step of placing said ring airfoil on said chuck includes the step of passing said ring airfoil over a cap located at a first end of said main support and along said main support to said chuck.

* * * * *